US009033760B2

(12) United States Patent
Filip

(10) Patent No.: US 9,033,760 B2
(45) Date of Patent: May 19, 2015

(54) INTERCHANGEABLE MODULAR DISPLAY AND CARRYING SYSTEM

(71) Applicant: Romeo Filip, Gilbert, AZ (US)

(72) Inventor: Romeo Filip, Gilbert, AZ (US)

(73) Assignee: Battle Foam LLC, Gilbert, AZ (US)

( * ) Notice: Subject to any disclaimer, the term of this patent is extended or adjusted under 35 U.S.C. 154(b) by 36 days.

(21) Appl. No.: 13/756,374

(22) Filed: Jan. 31, 2013

(65) Prior Publication Data

US 2013/0196567 A1 Aug. 1, 2013

Related U.S. Application Data

(60) Provisional application No. 61/593,646, filed on Feb. 1, 2012.

(51) Int. Cl.
*A63F 3/00* (2006.01)
*A63H 33/42* (2006.01)

(52) U.S. Cl.
CPC ..... *A63H 33/42* (2013.01); *Y10T 29/49826* (2015.01); *A63F 3/00574* (2013.01); *A63F 2003/00397* (2013.01); *A63F 2003/00347* (2013.01); *A63F 2003/00608* (2013.01); *A63F 2003/00391* (2013.01); *A63F 2003/00586* (2013.01); *A63F 3/00075* (2013.01); *A63F 2250/485* (2013.01); *A63F 2250/486* (2013.01)

(58) Field of Classification Search
CPC . A63H 33/42; A63F 3/00574; A63F 3/00075; A63F 2003/00586; A63F 2003/00608; A63F 2003/00397; A63F 2003/00347; A63F 2003/391; A63F 2250/485; A63F 2250/486
USPC ..... 446/75; 273/283, 284, 285, 287, 309; 220/630, 753, 756, 759
See application file for complete search history.

(56) References Cited

U.S. PATENT DOCUMENTS

| | | | | | |
|---|---|---|---|---|---|
| 2,808,191 | A * | 10/1957 | Cramer | ..... | 206/562 |
| 4,534,565 | A * | 8/1985 | Hube | ..... | 273/241 |
| 4,552,362 | A * | 11/1985 | Oake | ..... | 273/237 |
| 5,131,658 | A * | 7/1992 | Grenon | ..... | 473/185 |
| 5,250,000 | A * | 10/1993 | Boutin et al. | ..... | 446/75 |
| 6,155,564 | A * | 12/2000 | Tsai | ..... | 273/108.1 |
| 6,241,247 | B1 * | 6/2001 | Sternberg et al. | ..... | 273/148 B |
| 7,096,797 | B2 * | 8/2006 | Sharpe et al. | ..... | 108/43 |
| 7,325,803 | B1 * | 2/2008 | Miranda | ..... | 273/108.5 |
| 8,241,135 | B2 * | 8/2012 | Tsai | ..... | 473/10 |
| 8,635,959 | B1 * | 1/2014 | Silknitter | ..... | 108/43 |
| 2005/0252387 | A1 * | 11/2005 | Cornfield | ..... | 99/500 |

* cited by examiner

*Primary Examiner* — Vishu Mendiratta
(74) *Attorney, Agent, or Firm* — ZIP Law PLLC

(57) ABSTRACT

A method and apparatus for the display and transport of war gaming models, and more specifically a modular display system having interchangeable display and design panels to present and configure gaming figurines for competition and exhibition.

9 Claims, 12 Drawing Sheets

INTERCHANGEABLE MODULAR DISPLAY AND CARRYING SYSTEM

CROSS REFERENCE TO RELATED APPLICATIONS

This application claims the benefit of U.S. Provisional Application No. 61/593,646 filed Feb. 1, 2012 entitled Interchangeable Modular Display and Carrying System which is incorporated herein by reference in its entirety.

FIELD OF INVENTION

The present invention relates to a method and apparatus for the display and transport of war gaming models, and more specifically to a modular display system having interchangeable display and design panels to present and configure gaming figurines for competition and exhibition.

BACKGROUND OF THE INVENTION

The general class of role playing games encompasses a wide genre of character driven games wherein players interact via proxy characters. One variety of role playing games are miniature model "skirmish" games in which players control competing/cooperative factions with the individual members of each faction represented by miniature models which interact on a game board providing a character interaction area having terrain or other diagrammatic features thereon.

Within the dynamics of the skirmish game, there may be a requirement that the models be positioned at specific locations to be displayed. Additionally, the miniature models may be intricately designed and painted with realistic, humanistic features or be phantasmagorical creations with limbs, body parts, weapons or other extensions that may be easily broken if not protected. The present invention is a game display board for such miniature models.

OBJECT AND SUMMARY OF THE INVENTION

The present invention is directed to a modular display and carrying system that provides for positioning miniature models on a board and safely transporting them as required.

An object of the present invention is having an interchangeable display panel system that affixes to one or more handles to maintain the position of one or more miniature models and provide for transportation of the system while maintaining the position of each model.

Another object of the invention is to provide interchangeable panels of terrain or diagrammatic images for display and exhibition of miniature models.

Another object of the invention is to provide snap fit handles that integrate and interlock with the interchangeable panels.

Another object of the invention is the installation and removal of one or more handles without disrupting the position of each model within the playing surface of the display panel.

Another object of the invention is to provide multiple concentric shapes molded within one or more display panel designs to accommodate and secure miniature models having bases of various dimensions.

A further object of the invention is to provide a magnetic sheet of various image designs that affix to the display panel to decorate and identify the system, or to present terrain or architectural structures within the context of a skirmish game.

A still further object of the invention is multiple grooves within the snap fit handles and struts along each edge of the interchangeable panel to provide a secure rigid connection of the handles to the interchangeable panels to maintain a level alignment and prevent folding or bending of the panel.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE INVENTION

Figure 1:
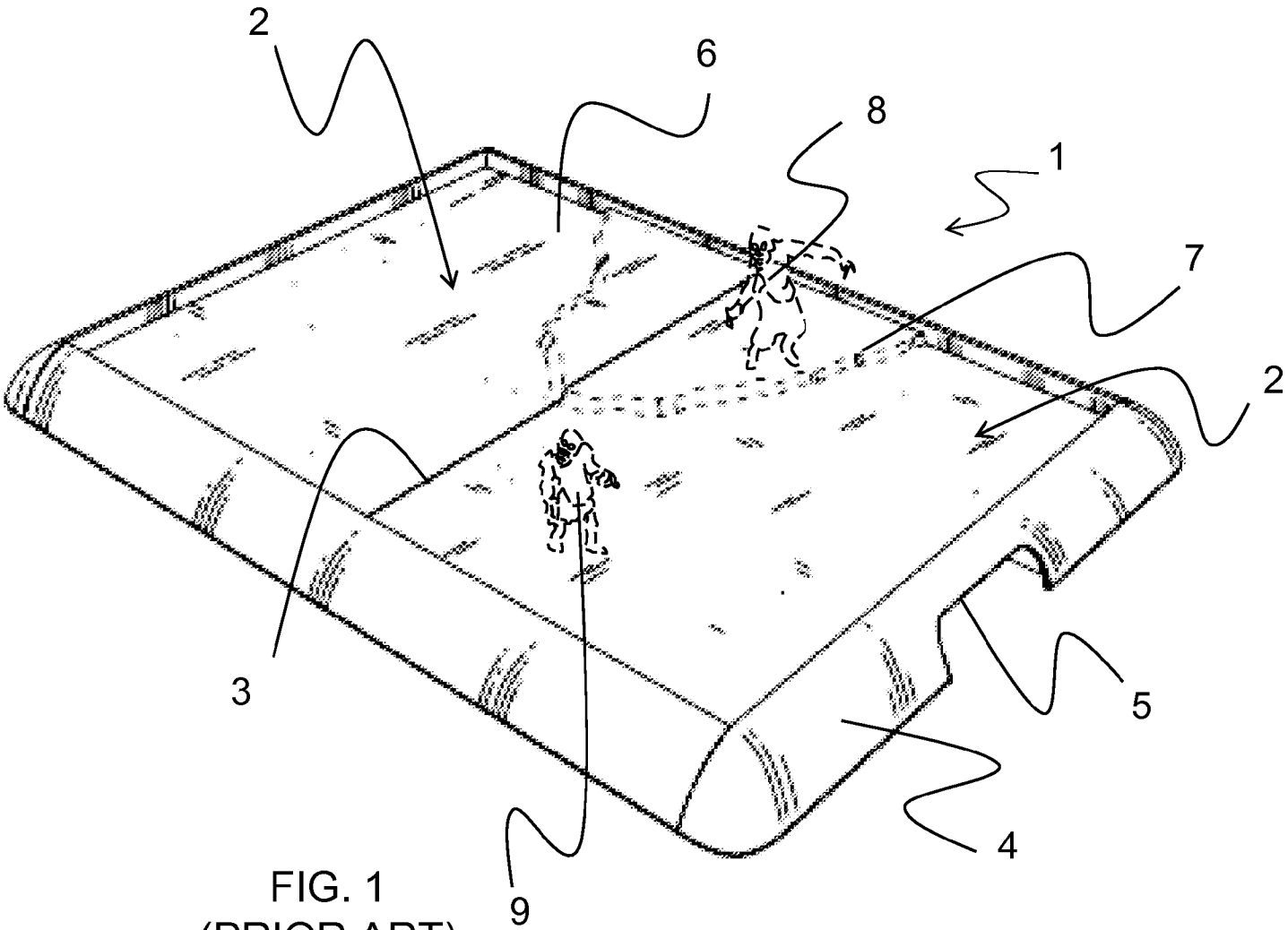
FIG. 1 (PRIOR ART)
FIG. 1 is a diagrammatic view of a prior art of a modular display board for display of miniature models.

The prior art of FIG. 1 shows a modular display board 1 disclosed in U.S. Pat. No. D653,707 to Filip having a one or more display panels 2 that are mated along a center line 3 and placed within a frame 4. The frame may have a cutout 5 on one or more sides to serve as a handle to support the display while carrying. The upper surface 6 is configured with an embossed terrain 7 to provide for the placement of miniature models 8 and 9 within a diagrammatic scene. During skirmish games the models, miniatures or game pieces are positioned in a specific location within a coordinate system and are directed towards a single model or group of models to determine distance, power, vulnerability or other characteristics that define the outcome of competitive battles within the parameters of the game. Tactical moves, skirmishes and battles may take several hours or days to complete and a requirement of mobility may be required over such long periods of time.

Importantly, in moving one or more game display boards or panels, the location of one or more game pieces in relation to all other game pieces is critical to maintain, in order to pause and resume the game at a precise point in time. Additionally the exhibition of a set of game pieces to show the strength of a competitor prior or during a match or simply a display for aesthetic value may be required to be transported to move the pieces to a game board, panel or field of play.

Figure 2:
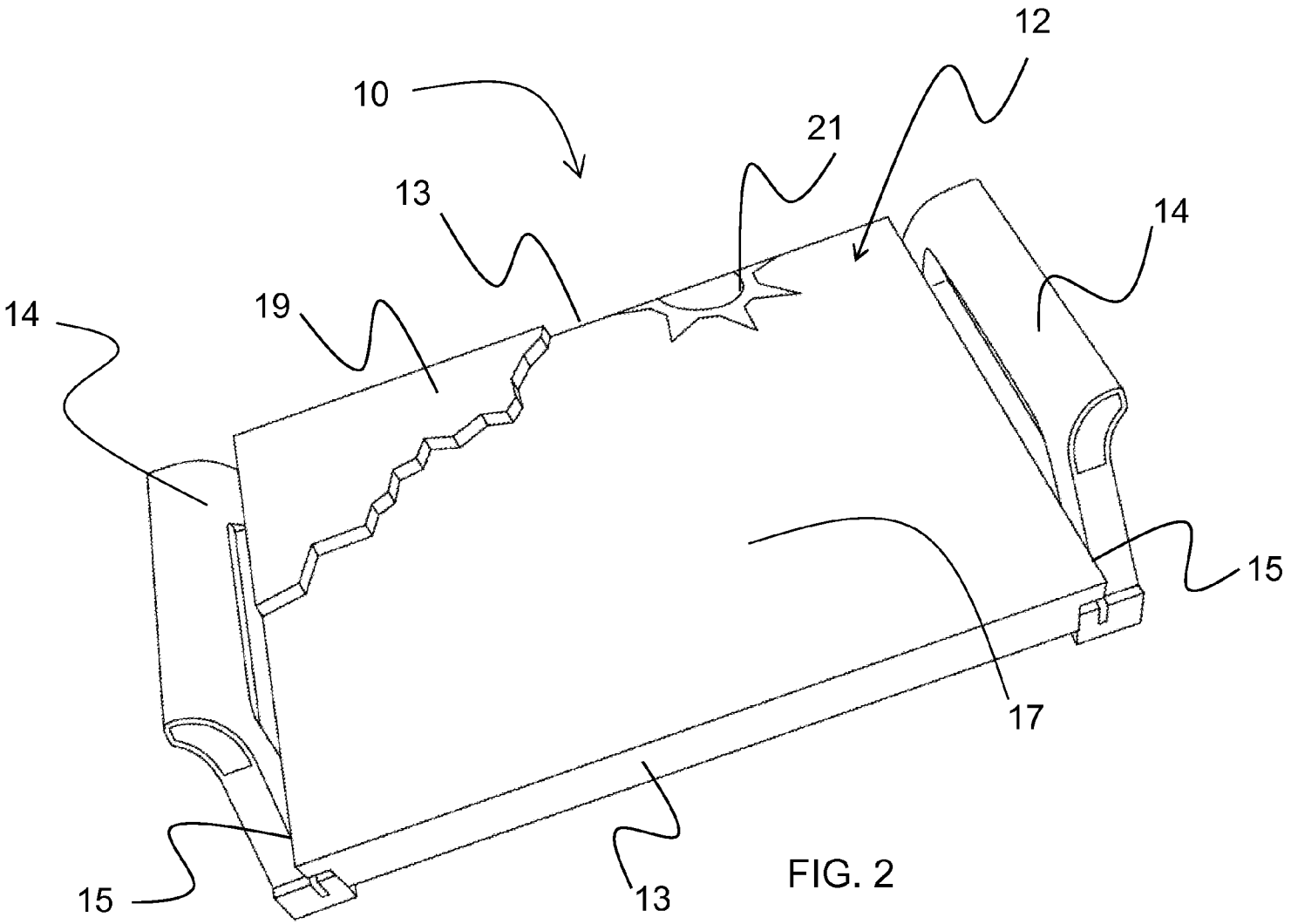
FIG. 2 is a perspective view of a first embodiment of the interchangeable modular display and carrying system.

The present invention as shown in FIG. 2 discloses an interchangeable display system 10 that secures the positions of models on a display panel 12 that is easily transportable using preformed handles 14. In a first embodiment, the display panel 12 may be rectangular in shape with a lengthened side 13 and a shortened side 15 for the attachment of the handle 15. In further embodiments, the display panel may be triangular, circular or of any shape with the handles 14 positioned appropriately to accommodate the skill and diagrammatic requirements of a particular skirmish game or other competition. The display panel 12 has an upper surface 17 that may be embossed with a terrain 19, or be detailed with colorful images or designs 21. In further embodiments, intricate patterns, floor plans, three dimensional structures or other features may be affixed to the display panel 12. The display panel 12 and sides may be decorated with team names, logos or other information.

Figure 3A:
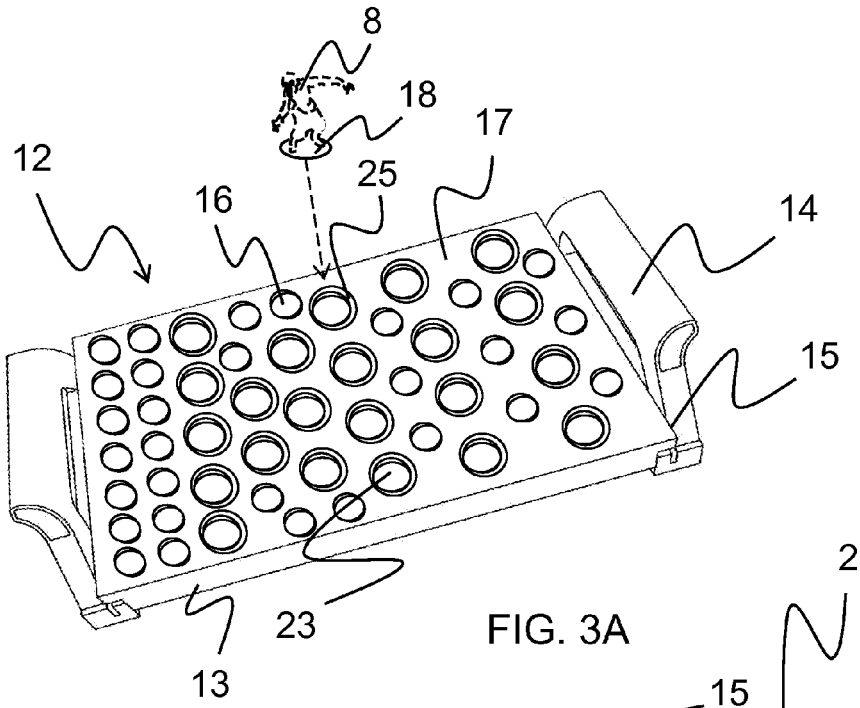
FIG. 3A is a perspective view of a further embodiment of the interchangeable modular display and carrying system having a concentric shape design panel.

As shown in FIG. 3A the panel 12 may have a first series of single level concentric shapes 16 and multi-level concentric shapes 23 to accommodate the different sizes of the bases 18 of various miniature models 8. In a first embodiment, the circular design shape mates with the model base 18 to keep the model 8 from slipping across the board during play or transportation. The multi-level concentric shapes 23 provide a multi-tier 25 to provide for models of various sizes to fit within the same position depending upon the game parameters and needs of the user.

Figure 3B:
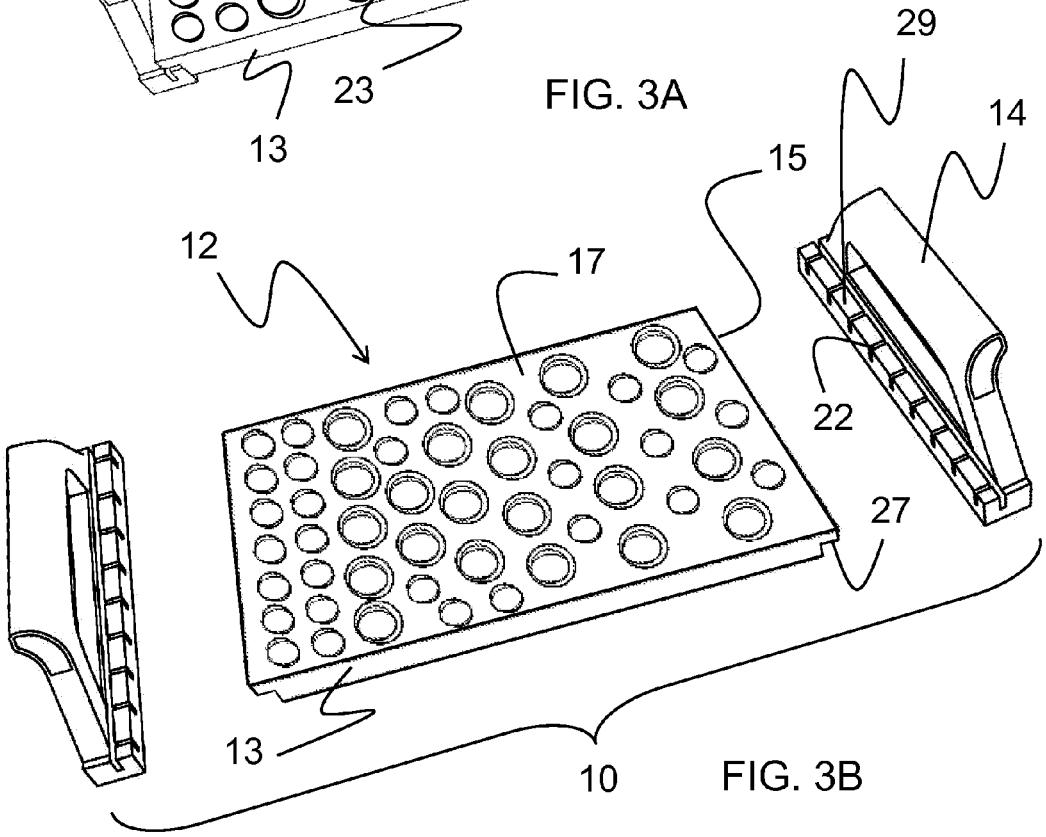
FIG. 3B is an exploded view of the further embodiment of the interchangeable modular display and carrying system having a concentric shape design panel.

As shown in FIG. 3B, the interchangeable modular display and carrying system includes the display panel 12 and one or more handles 14 to support and transport the system. The shortened side 15 of the display panel 12 has a first edge 27 that extends out from the panel 12 to extend over a handle support 29 that provides a series of grooves 22 that interlock with the panel 12 as described herein.

Figure 4A:
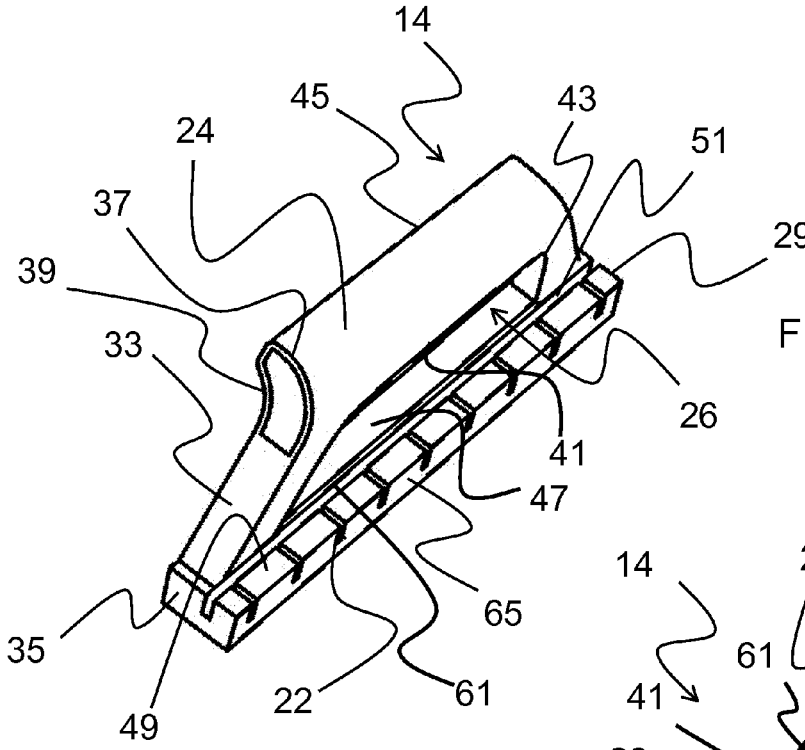
FIGS. 4A and 4B are perspective views of an embodiment a left and right handles of an embodiment of the interchangeable modular display and carrying system.
Figure 4B:
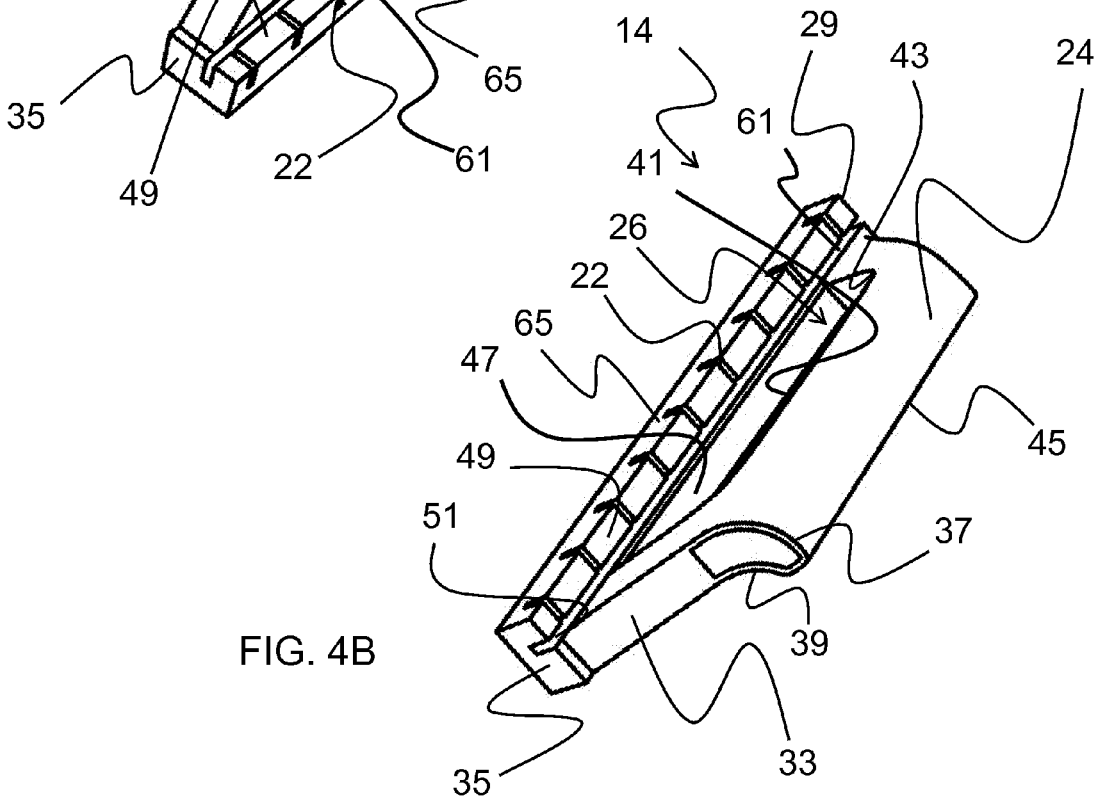

The handles 14 as shown in FIGS. 4A and 4B are ergonomically shaped with a rounded portion 24 that is easily cupped by the palm of the hand and or the thumbs of the user to hold and carry the display system 10 in a stable manner. A wide opening 26 is provided to easily fit a user's hand through the opening and lift the system 10 without disrupting or knocking over the models or objects within the display. The opening 26 is formed from two lateral extensions 33 that angularly extend from the base 35 of the handle 14. The extensions 33 are formed in an upper curve that has a front portion 37 that creates the smooth rounded upper surface 24 and a rear portion 39 that supports the palm of a hand along the lower surface 41 of the handle 14. Rounded edges 43 may be formed where the lateral extensions 33 curve, extend parallel to the base 35 and meet to form the handle 14. The rear surface 45 of this parallel extension may also be rounded.

Figure 6:
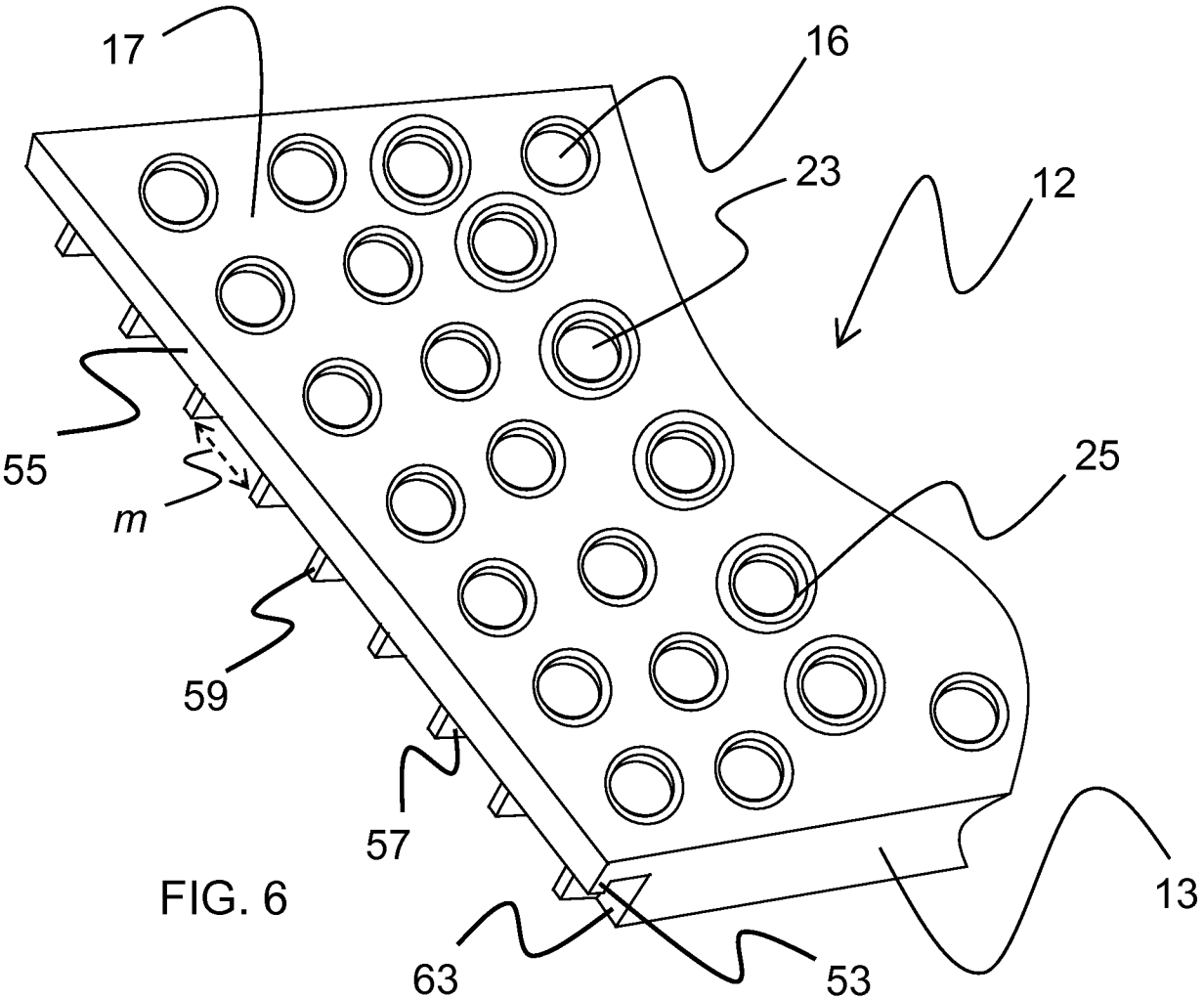
FIG. 6 is a perspective view of a portion of an embodiment of the interlocking struts along the edge of the interchangeable panel in an embodiment of the interchangeable modular display panel.

An inner section 47 of the base 35 of the handle 14 may be level with the handle support 29 or be slightly raised to more easily balance a display panel 12 filled with model figurines 8 and 9. The series of grooves 22 within the handle support 29 may be evenly spaced with a flat surface 49 formed between each groove to support the display panel 12. Between the base inner section 47 and the handle support 29 a lip or channel 51 may be formed that in a first embodiment may mate with an opposing lip or channel 53 formed on the display panel 12 as shown in FIG. 6. When the panel 12 and handle pieces 14 are interlocked, the edge 55 of the shortened side 15 of the panel 12 and the outer edge 59 of the panel struts 57 abut a rear flat surface 61 of the handle support 29. An inner surface 63 of the panel 12 abuts the front surface 65 of the handle support 29.

Figure 5A:
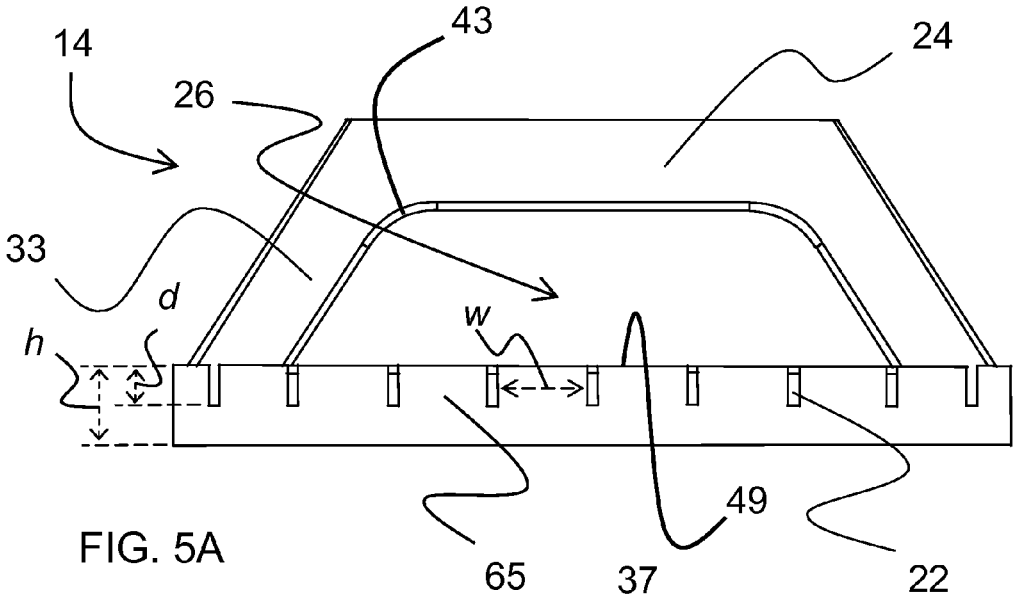
FIG. 5A is an elevation view of the interior side of an embodiment of the handle in an embodiment of the interchangeable modular display and carrying system.
Figure 5B:
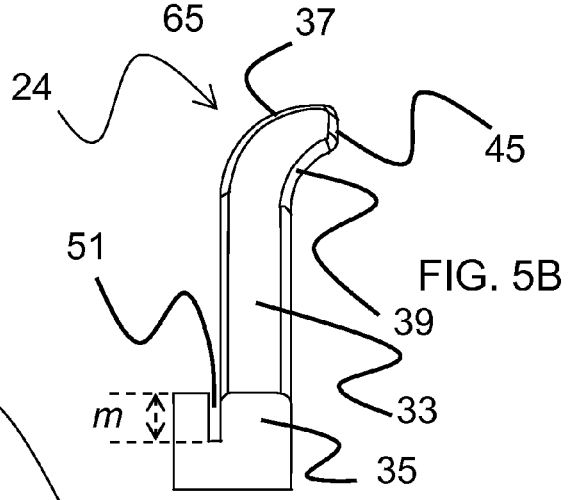
FIG. 5B is a side view of an embodiment of the handle in an embodiment of the interchangeable modular display and carrying system.
Figure 5C:
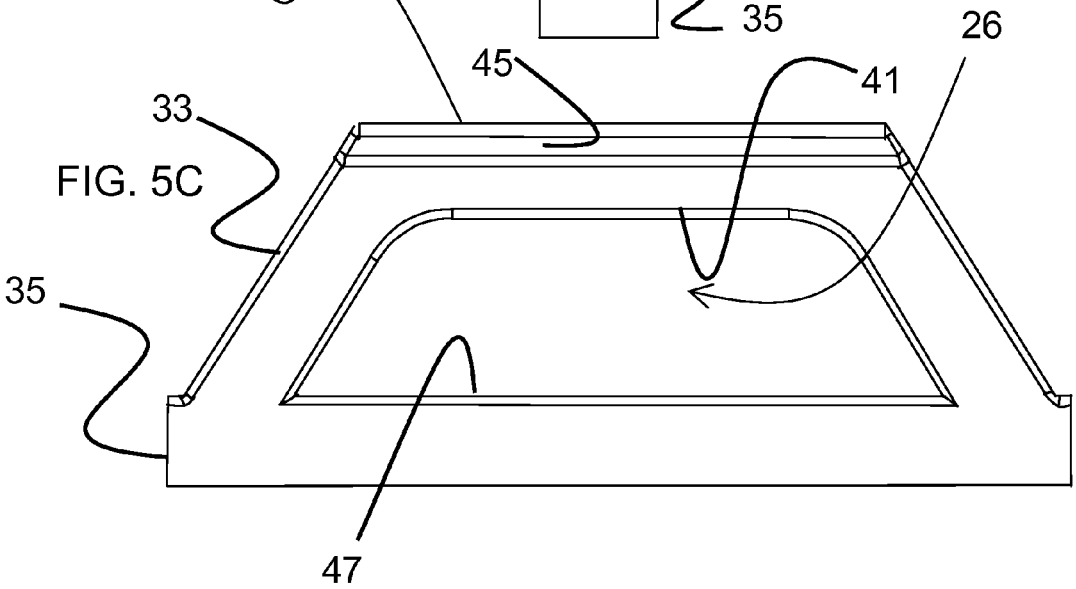
FIG. 5C is an elevation view of the exterior side of an embodiment of the handle in an embodiment of the interchangeable modular display and carrying system.

An elevation view showing the interior of the handle is shown in FIG. 5A. The grooves or slots 22 within the handle support 29 extend a distance d from the handle support surface 49 which is approximately ½ to ¾ of the height h of the support 29. Importantly, a plurality of grooves 22 are formed within the handle support 29 each at a limited distance w apart from one another. The plurality of grooves 22 mate with the plurality of struts 57 that are formed on the display panel 12. By minimizing the distance w between each groove 22 and mating strut 57, support for the display is strengthened and any deflection, twisting, or bending of the panel 12 is minimized even under substantial loads from multiple metallic or other heavier material models or figurines located on the game board surface 17. As shown in FIG. 5B, the channel 51 within the handle support 29 extends a distance m that is substantially ½ or ¾ of the total height h of the handle support 29 to properly secure the lip 53 of panel 12 within the channel 51. The curved rear edge 45 of the handle and rounded upper portion 24 is also shown. The rear view of the handle 14 shown in FIG. 5C displays the wide opening 26 for a hand to easily slip through properly grasp the upper rounded portion 24 and securely grip the handle 14 to properly support a fully loaded display panel 12.

Figures 7A, 7B, 7C:
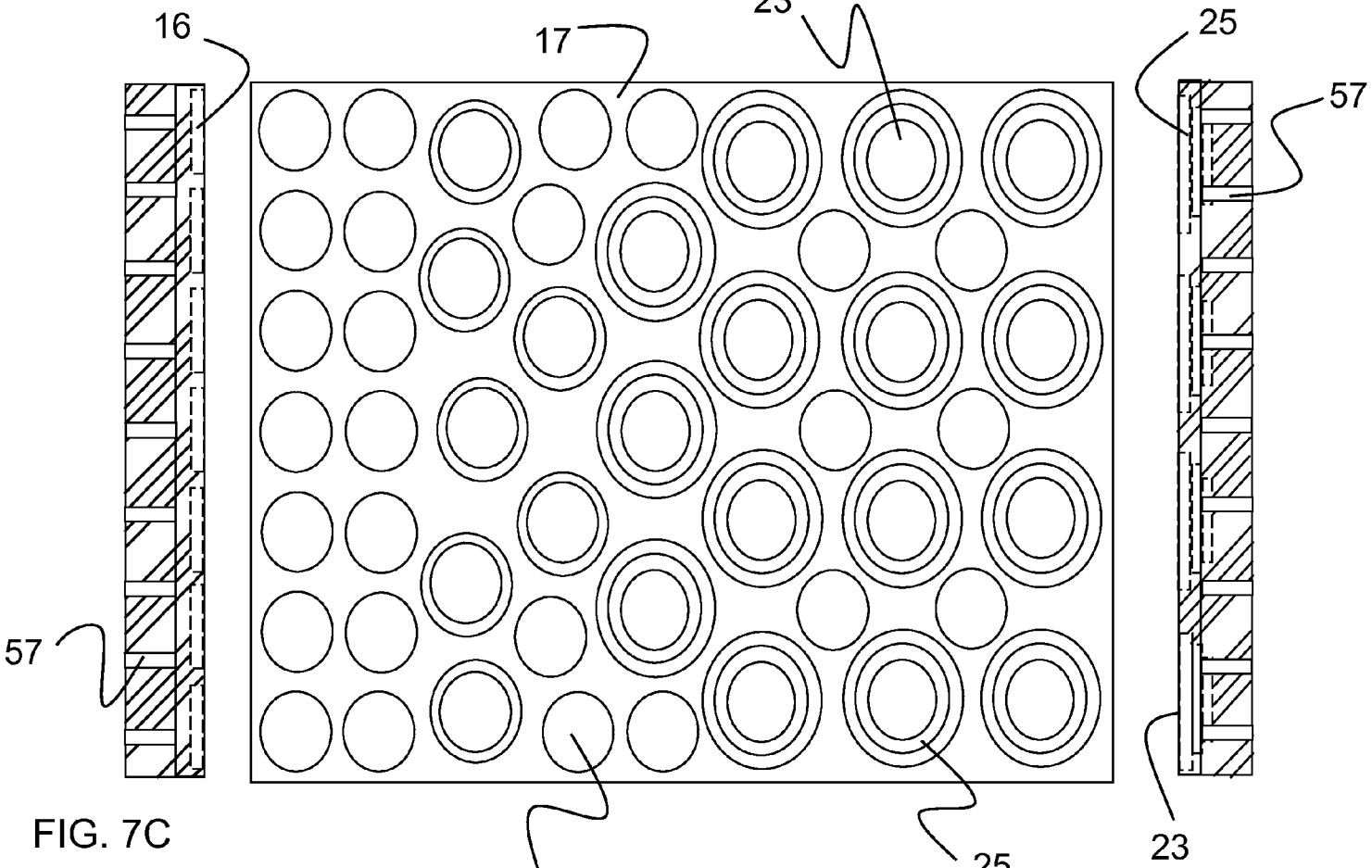
FIG. 7A is a left side view of an embodiment of the interchangeable panel in an embodiment of the interchangeable modular display panel.
FIG. 7B is a top view of an embodiment of the interchangeable panel in an embodiment of the interchangeable modular display panel.
FIG. 7C is a right side view of an embodiment of the interchangeable panel in an embodiment of the interchangeable modular display panel.

A portion of the display panel 12 is shown FIG. 6 with the plurality of struts positioned along the shortened side 15 of the panel 12. As described herein, the distance m between each strut is comparable to the distance m between the handle grooves 22 to minimize any rotation or twisting of the panel 12 under a load. A series of smaller concentric shapes 16 and larger multi-level concentric shapes 23 each with multi-tiers 25 are also shown on the surface 17 of the panel 12. As shown in the side views of FIGS. 7A and 7C and the top view of FIG. 7B, the multi-tiers 25 are cut into the panel 12 at different diameters and depths to create a series of shelves for a base 18 of a model 8 or 9 to be placed within and secure the model to the panel thereby restricting movement and reducing the risk of the model toppling over. Any number and design of shapes may be formed within the top surface 17 of the panel 12 to accommodate the base and support designs of various model figurines.

Figure 8A:
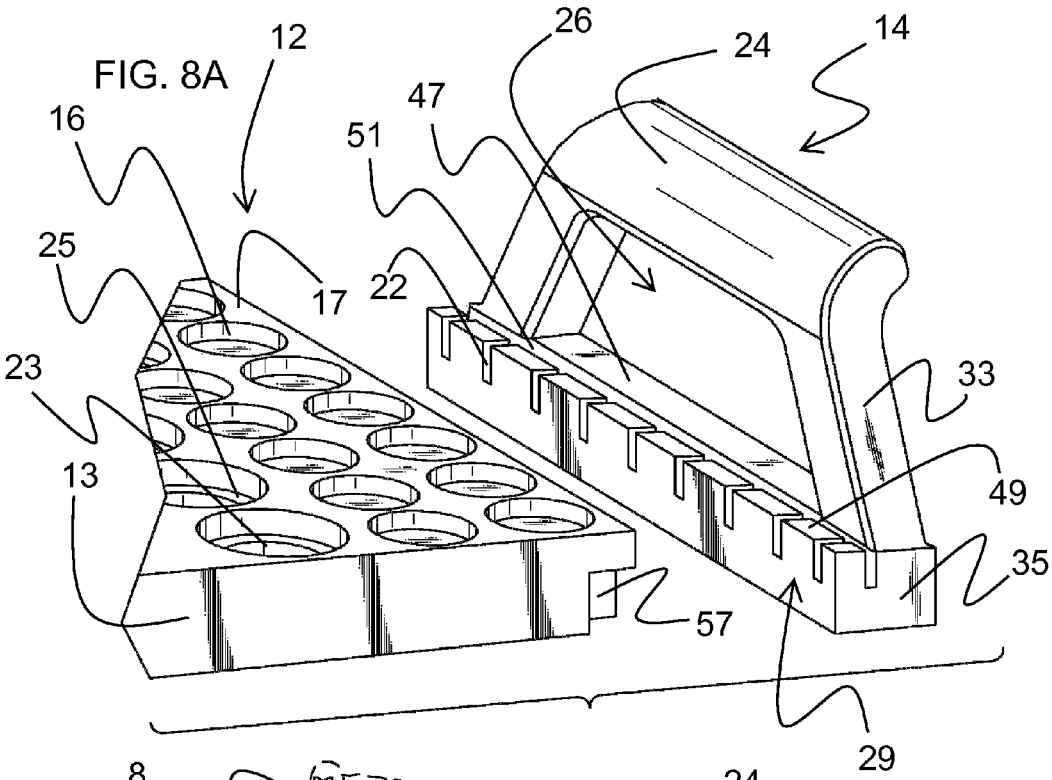
FIG. 8A is a perspective view of a portion of an embodiment of the interchangeable panel and handle in an embodiment of the interchangeable modular display and carrying system.
Figure 8B:
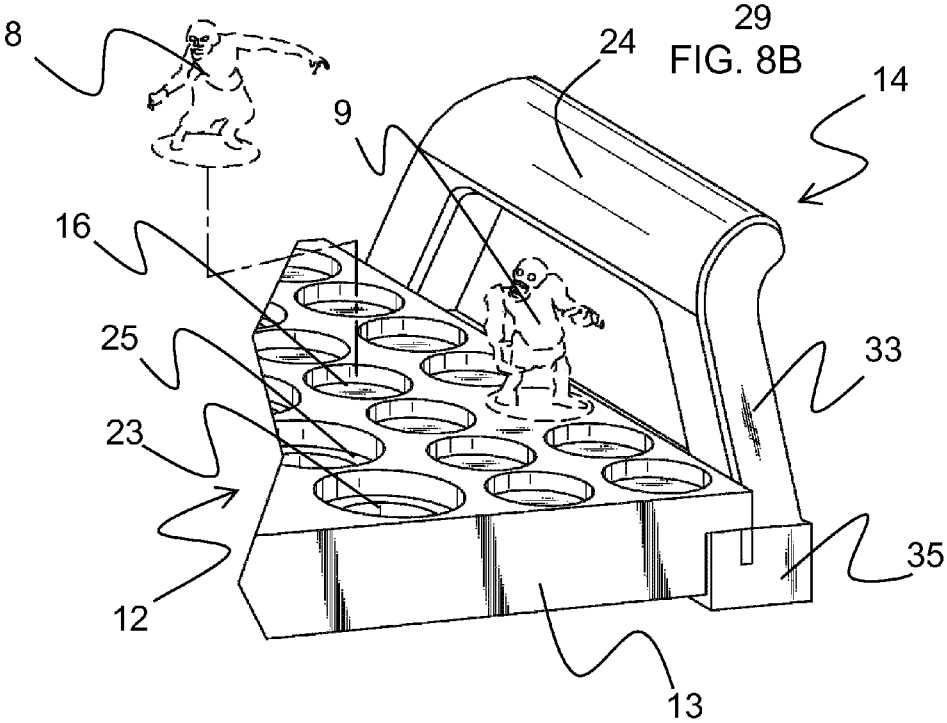
FIG. 8B is a perspective view of a portion of an embodiment of the interchangeable panel and handle in an embodiment of the interchangeable modular display and carrying system showing the placement of models into the concentric shapes of the display panel.

As shown in FIG. 8A, the panel struts 57 align with the handle support 29 and interlock the display panel 12 and handle 14 with the short distances between the struts 57 and grooves 22 to provide superior support strength and prevent the display panel from bending or twisting under heavy loads. Importantly, in an embodiment of the interchangeable modular carrying system, a single handle may be installed or removed by sliding the handle into place and then supporting the display panel on the handle without disrupting the location of the models within the playing surface of the display panel. As shown in FIG. 8B, a model 9 is positioned within a concentric shape 16 that matches the base 18 of the model 9. A model 8 with a smaller base 18 may be positioned in the smaller concentric shape 16 as shown. The concentric shape is dimensioned with a minimal tolerance between the base 18 and the concentric shape 16 or 23 to secure the model in the position with a releasable frictional fit to prevent disruption of the position of the model during game play and in transport of the interchangeable modular display and carrying system.

Figure 9:
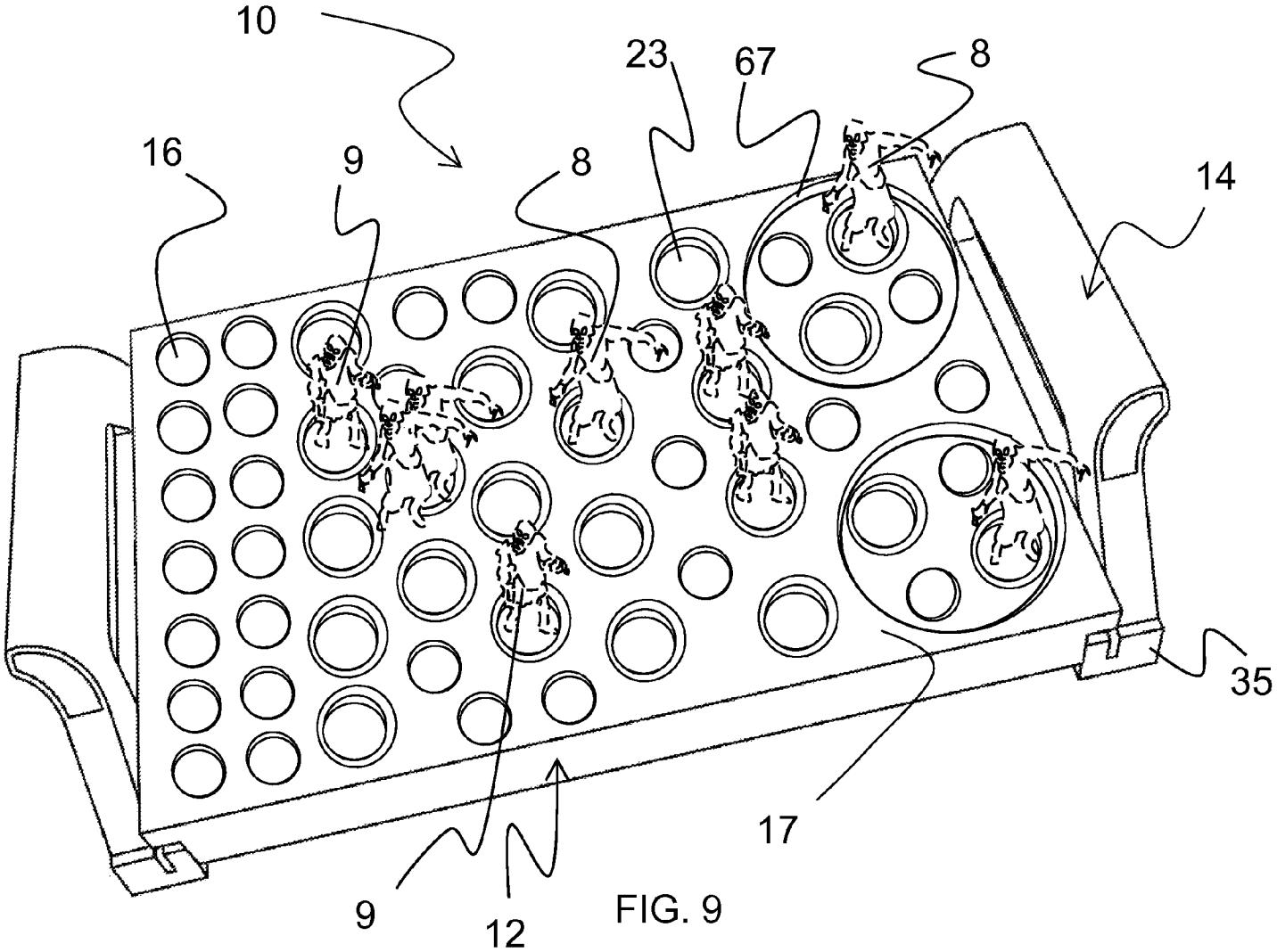
FIG. 9 is a perspective view of an embodiment of the interchangeable modular display and carrying system showing the placement of models into the concentric shapes of the display panel.
Figure 10:
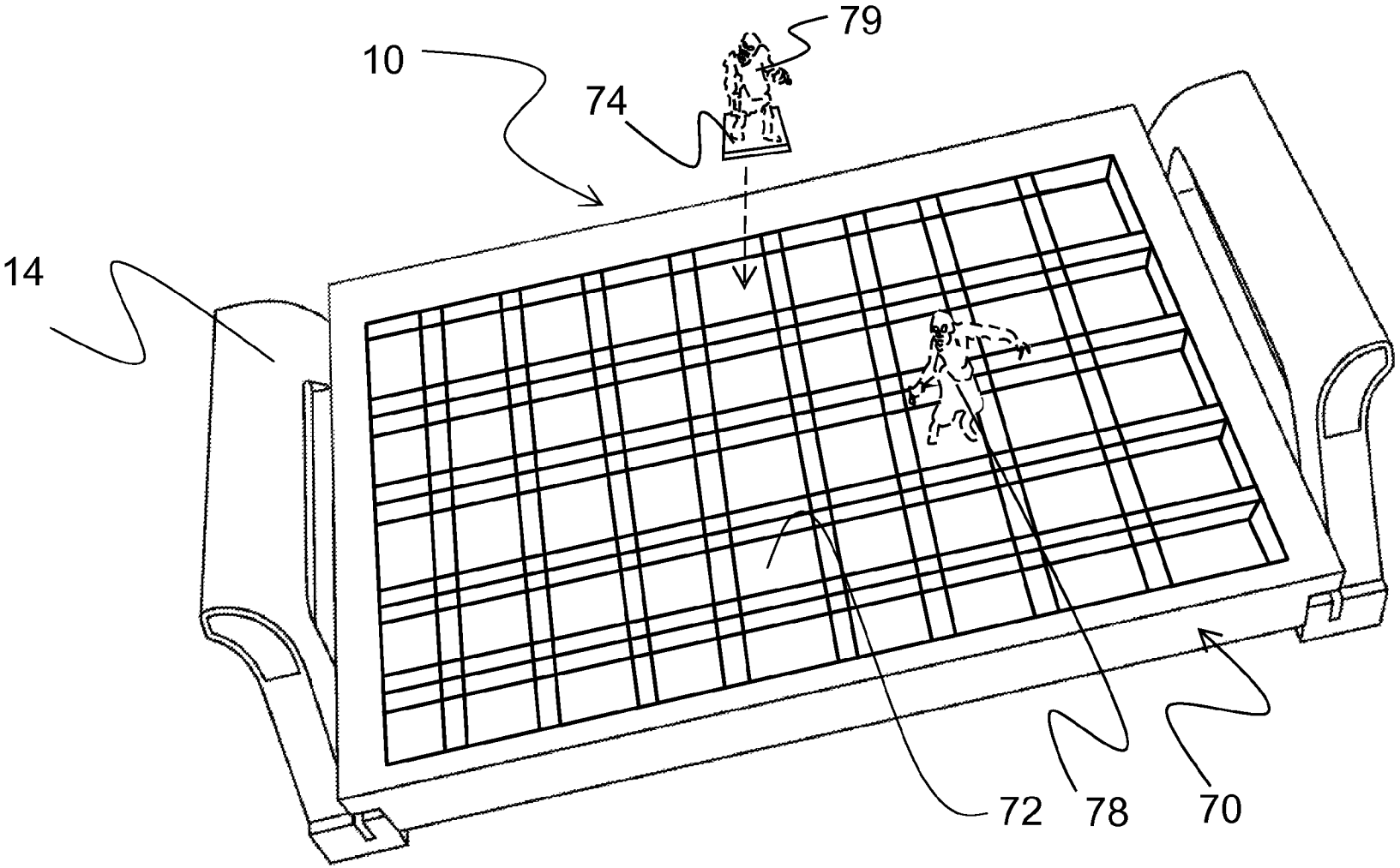
FIG. 10 is a perspective view of a further embodiment of an interchangeable display panel and carrying system of an embodiment of the interchangeable modular display.

A collection of models of different configurations positioned within the concentric shapes is shown in FIG. 9. As an example, the panel 12 may be configured to accept models of miniature toys from 25 mm to 28 mm designed for table top wargames or be able to accept much larger based models within a multitier 67 that surrounds a number of other concentric shapes. As shown in FIG. 10, the interchangeable panel 72 may be of any format shape 72 that accommodates the base 74 of the model 79 with the interchangeable modular system 10 providing for the modular attachment of the square shape format panel 72 to the handle 14 to interlock with the panel 72 and provide structural support for gameplay and transport. As described herein, the handle 14 attaches to the modular panel 72 by providing a series of slots or grooves 22 dimensioned to mate with a series of struts 57 on the panel 72. Based on the dimensions and types of models used fewer struts 57 may be provided on the panel 72 and be mated with less than the total number of grooves 22. Each groove 22 aligns and interlocks the panel 72 to the handle 14 providing support translaterally across the panel to prevent folding or bending of the panel 12 thereby securing each model in an upright position. The grid design of display panel 72 may be used to match the shape of square tokens or other playing pieces that are specific to a particular game or activity. Other uniform designs may be used or one or more mixed and matched designs with each configuration of panel 12 interlocking with the handles 14 to provide an interchangeable display system 10 that can be supported and carried from one gaming location to another without disruption of the models and or pieces on the panel 12.

Figure 11:
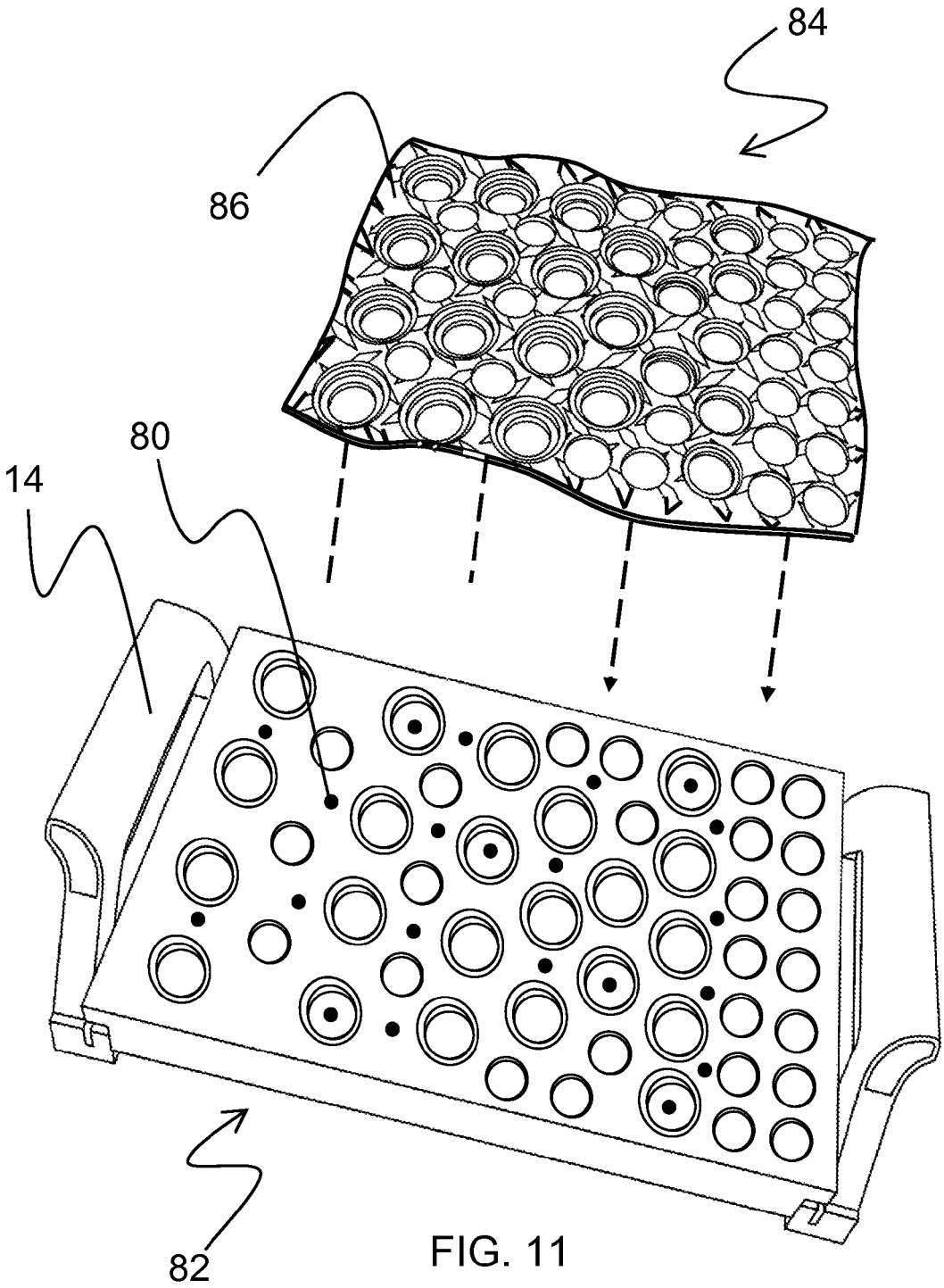
FIG. 11 is a perspective view of an embodiment of the interchangeable modular display and carrying system and a variable terrain sheet that adheres to the display using magnets.
Figure 12:
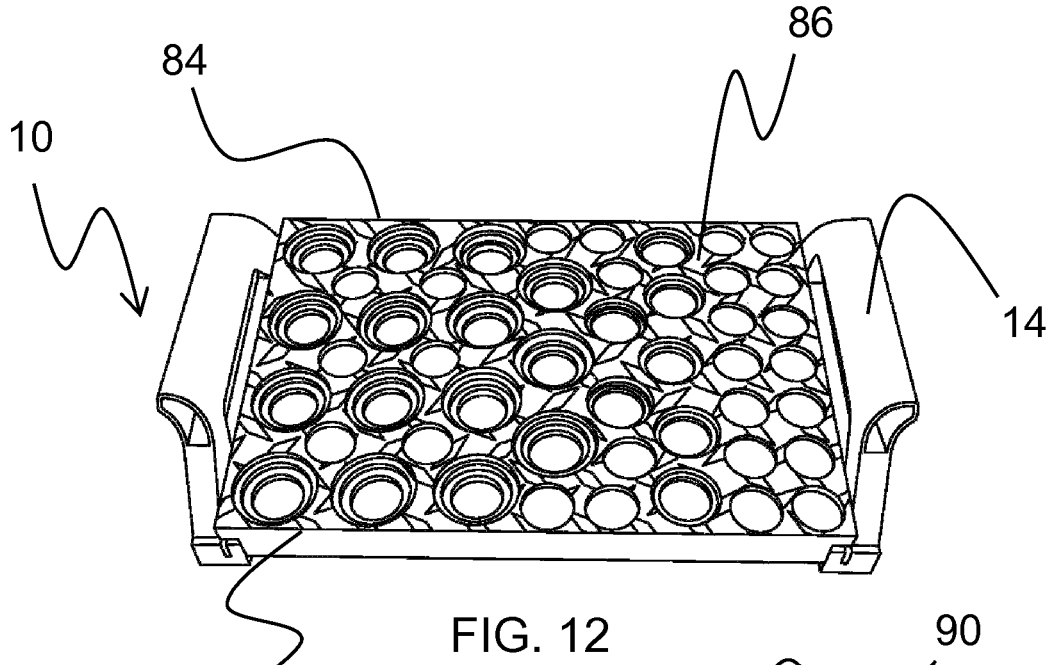
FIG. 12 is a perspective view of an embodiment of the interchangeable modular display and carrying system with a first embodiment of a variable terrain design sheet.
Figure 13:
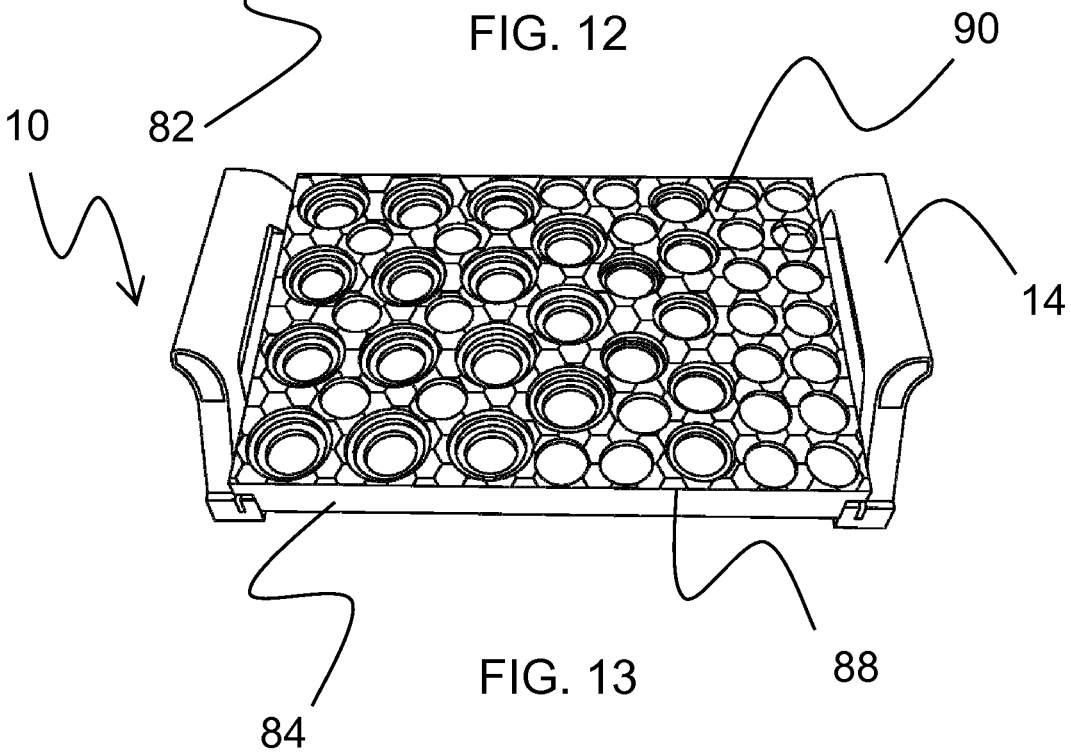
FIG. 13 is a perspective view of an embodiment of the interchangeable modular display and carrying system with a further embodiment of a variable terrain design sheet.

The panel 12 and handles 14 may be made of any sturdy composite such as plastic, polycarbonates, ceramics or metals depending upon the size requirements of the playing field and other game parameters and considerations. In a further embodiment, the panel 82 may have one or more rare earth or other magnets 80 affixed to or secured within the panel 82 to provide a magnetic surface for the attachment of metal or magnetic based miniature models. The magnets 80 may further be positioned at locations along the edge or across the interior of the panel as shown in FIG. 11. Design pattern sheets 84 that match the panel configurations may provide textured surface 86 or scenes, terrain or architecture within the context of the game dynamic. The design pattern sheets 84 may be formed from metal or magnetic sheets that have one or more printed images and that may be placed over the display panel 82. The design pattern sheet 84 may also have cut outs to provide for aligning the design pattern with the concentric shapes 16 and 23 of the panel 82, providing for a miniature model to be inserted through the affixed design pattern sheet 84 and be inserted in the appropriate shape. As shown in FIG. 12, the design pattern sheet 84 lays flat and is secured on the panel 82 using the magnets 80. The magnets 80 also provide for the design pattern sheet 84 to be easily removed and replaced with another design pattern sheet 88 having a differently patterned surface 90 as shown in FIG. 13. The pattern surfaces may display an artistic work of a scene or terrain, a logo, a team name, or a pattern such as wood grain, metal and or other colorful design.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. An interchangeable, modular display system for miniature models used in wargaming, comprising:

a display panel having a plurality of struts along at least one edge;

at least one handle having a plurality of grooves interlocked with the plurality of struts and supporting the display panel in a lateral position to support one or more miniature models used in wargaming, the display panel having one or more magnets;

a miniature model that adheres to the one or more magnets of the display panel; and wherein the display panel may be interchanged with the at least one handle without disrupting the alignment or position of one or more miniature models supported on the panel.

2. The interchangeable, modular display system of claim 1 further comprising a lip and channel to interlock the at least one handle with the display panel.

3. The interchangeable, modular display system of claim 1 wherein the handle is slidably connected to the display panel.

4. The interchangeable, modular display system of claim 1 wherein the display panel further comprises an embossed pattern.

5. The interchangeable, modular display system of claim 1 wherein the display panel further comprises one or more multi-tiered cutouts to support one or more miniature models.

6. The interchangeable, modular display system of claim 5 wherein the multi-tiered cutouts are of various dimensions.

7. The interchangeable, modular display system of claim 5 wherein the multi-tiered cutouts provide a releasable frictional fit to a miniature model within the display panel.

8. The interchangeable, modular display system of claim 1 further comprising a design pattern sheet that adheres to the one or more magnets of the display panel.

9. The interchangeable, modular display system of claim 1 wherein the plurality of grooves are formed at a limited distance apart from one another and the plurality of grooves mate with the plurality of struts to minimize any deflection, twisting, or bending of the display panel.

* * * * *